US009522722B1

(12) United States Patent
Brouillette et al.

(10) Patent No.: US 9,522,722 B1
(45) Date of Patent: Dec. 20, 2016

(54) PERSONAL WATERCRAFT EXHAUST SYSTEM

(71) Applicant: BOMBARDIER RECREATIONAL PRODUCTS INC., Valcourt (CA)

(72) Inventors: Steve Brouillette, Sherbrooke (CA); Sebastien Clement, St-Denis de Brompton (CA)

(73) Assignee: BOMBARDIER RECREATIONAL PRODUCTS INC., Valcourt (CA)

( * ) Notice: Subject to any disclaimer, the term of this patent is extended or adjusted under 35 U.S.C. 154(b) by 52 days.

(21) Appl. No.: 14/669,151

(22) Filed: Mar. 26, 2015

Related U.S. Application Data

(63) Continuation of application No. 13/749,957, filed on Jan. 25, 2013, now abandoned.

(60) Provisional application No. 61/592,798, filed on Jan. 31, 2012.

(51) Int. Cl.

| | |
|---|---|
| ***B63H 21/32*** | (2006.01) |
| ***B63H 21/00*** | (2006.01) |
| ***F01N 13/00*** | (2010.01) |
| ***B63H 11/00*** | (2006.01) |

(52) U.S. Cl.
CPC ..... *B63H 21/32* (2013.01); *B63H 11/00* (2013.01); *B63H 21/24* (2013.01)

(58) Field of Classification Search
CPC .... B63H 21/32; B63B 2770/00; F01N 13/004; F01N 2590/022; F01N 13/1805; F01N 13/085; F01N 1/02; F01N 13/1816; F01N 2340/04; F02B 61/045
USPC ..... 440/89 R, 89 J, 89 C, 89 E, 89 F
See application file for complete search history.

(56) References Cited

U.S. PATENT DOCUMENTS

| | | | |
|---|---|---|---|
| 5,046,977 | A | 9/1991 | Rodskier |
| 6,213,827 | B1 | 4/2001 | Hattori et al. |
| 6,290,557 | B1 * | 9/2001 | Yokoya ..... F01N 1/003 181/232 |
| 6,419,533 | B2 | 7/2002 | Lecours |
| 6,612,885 | B2 | 9/2003 | Yamazaki et al. |
| 6,679,742 | B2 | 1/2004 | Yokoya et al. |

(Continued)

OTHER PUBLICATIONS

Bombardier Recreational Products Inc.; BRP-Part Catalogs; Sea-Doo Watercraft/2011/GTI/GTI 130, 2011/01-Exhaust System; http://epc.brp.com/; retrieved from Internet on Mar. 26, 2015.

(Continued)

*Primary Examiner* — Anthony Wiest
(74) *Attorney, Agent, or Firm* — BCF LLP

(57) ABSTRACT

A personal watercraft has a hull having an exhaust aperture and a longitudinal centerline, a deck disposed on the hull, a straddle seat, an engine, a driveshaft operatively connected to the engine and extending rearwardly thereof, a jet propulsion system operatively connected to the driveshaft, an exhaust manifold connected to a lateral side on the engine on a first side of the longitudinal centerline, the exhaust manifold having a manifold outlet, a muffler disposed generally transversely and rearwardly of the engine, the muffler having a muffler inlet on the first side of the longitudinal axis and a muffler outlet, a first exhaust pipe connected to the manifold outlet and to the muffler inlet, and a second exhaust pipe connected to the muffler outlet and to the exhaust aperture. The second exhaust pipe extends upwardly and rearwardly from the muffler outlet, then downwardly and rearwardly to the exhaust aperture.

18 Claims, 8 Drawing Sheets

(56) References Cited

U.S. PATENT DOCUMENTS

| | | | |
|---|---|---|---|
| 6,688,929 | B2 | 2/2004 | Lecours et al. |
| 6,837,173 | B2 | 1/2005 | Eck et al. |
| 6,896,568 | B2 | 5/2005 | Matsuda |
| 7,455,035 | B2 | 11/2008 | Sanai |
| 7,980,070 | B2 | 7/2011 | Mashiko et al. |
| 7,993,597 | B2 | 8/2011 | Kinomoto et al. |

OTHER PUBLICATIONS

Bombardier Recreational Products Inc.; BRP-Part Catalogs; Sea-Doo Watercraft/2011/GTI/GTI 130, 2011/09-Hull 2; http://epc.brp.com/; retrieved from internet on Mar. 26, 2015.

* cited by examiner

PERSONAL WATERCRAFT EXHAUST SYSTEM

CROSS-REFERENCE

The present application is a continuation of U.S. patent application Ser. No. 13/749,957, filed Jan. 25, 2013, which claims priority to U.S. Provisional Patent Application No. 61/592,798, filed Jan. 31, 2012, the entirety of both of which is incorporated herein by reference.

TECHNICAL FIELD

The present invention relates to an exhaust system for a personal watercraft.

BACKGROUND

Personal watercraft are typically constructed by attaching a deck to a hull to form an engine compartment therebetween. The propulsion systems for these personal watercraft normally include an inboard-mounted, internal combustion engine and a jet propulsion unit in the form of an impeller assembly positioned in a tunnel open to the underside and the stern of the hull. Due to the compact size of personal watercraft, limited space is available within the hull.

The compactness of personal watercraft presents a number of unique design problems. One such design problem is the layout of the exhaust system for discharging exhaust gases generated by the engine. This problem is rendered particularly acute because, as is typical with marine propulsion systems, the engine exhaust gases are typically discharged to the atmosphere either at, below or close to the water level depending on the speed of the watercraft. For example, at slow speeds the exhaust outlet may be below the waterline. At high speeds, the exhaust outlet is located at a higher position and may be above the waterline. Due to this location of the exhaust outlet, care must be taken to ensure that water cannot enter the engine through the exhaust system. This problem is compounded because there is a possibility that the watercraft could capsize. Therefore, when capsized and subsequently righted, an adequate exhaust system design ensures that any water that has entered the exhaust system is prevented from finding its way into the engine. Additionally, under normal operating conditions, the exhaust system must be designed to inhibit coolant water that is directed into the muffler via a water jacket or water injection from entering the engine.

Therefore, there is a need for a relatively compact exhaust system for a personal watercraft that helps prevent the entry of water into the engine. There is also a need for a personal watercraft having such an exhaust system.

SUMMARY

It is an object of the present invention to ameliorate at least some of the inconveniences present in the prior art.

In one aspect, a personal watercraft is provided. The personal watercraft has a hull having an exhaust aperture and a longitudinal centerline, a deck disposed on the hull, a straddle seat disposed on the deck, an engine connected to the hull, a driveshaft operatively connected to the engine and extending rearwardly thereof, a jet propulsion system operatively connected to the driveshaft, an exhaust manifold connected to a lateral side on the engine on a first side of the longitudinal centerline, the exhaust manifold having a manifold outlet, a muffler disposed generally transversely and rearwardly of the engine, the muffler having a muffler inlet on the first side of the longitudinal axis and a muffler outlet, a first exhaust pipe connected to the manifold outlet and to the muffler inlet, and a second exhaust pipe connected to the muffler outlet and to the exhaust aperture. The exhaust aperture is disposed rearwardly of the muffler. The second exhaust pipe extends upwardly and rearwardly from the muffler outlet, then downwardly and rearwardly to the exhaust aperture.

In a further aspect, the muffler outlet is disposed on a second side of the longitudinal centerline.

In an additional aspect, the first exhaust pipe is disposed on the first side of the longitudinal centerline and the second exhaust pipe is disposed on the second side of the longitudinal centerline.

In a further aspect, the muffler has an inlet end, an outlet end and a central axis. The central axis extends downwardly from the inlet end to the outlet end.

In an additional aspect, the central axis extends forwardly from the inlet end to the outlet end.

In a further aspect, a bracket connects the muffler to the engine.

In an additional aspect, the bracket is connected to an end portion of the muffler having the muffler outlet.

In a further aspect, the manifold outlet faces generally rearwardly and the muffler inlet faces generally forwardly.

In an additional aspect, the muffler outlet faces generally upwardly.

In a further aspect, the hull defines a tunnel. At least a portion of the jet propulsion system is disposed in the tunnel. The exhaust aperture is defined in a wall of the tunnel.

In an additional aspect, the second exhaust pipe extends forwardly as the second exhaust pipe extends downwardly and then extends rearwardly.

In a further aspect, a resonator is connected to the second exhaust pipe.

In additional aspect, the resonator is connected to the second exhaust pipe via an aperture in a top of the second exhaust pipe. The resonator is disposed above the aperture in the top of the second exhaust pipe.

In a further aspect, the aperture in the top of the second exhaust pipe is disposed between a downwardly extending portion of the second exhaust pipe and the exhaust aperture.

In an additional aspect, the resonator includes a first resonator portion connected to a second resonator portion.

In a further aspect, the first resonator portion is integrally formed with a first portion of the second exhaust pipe and the second resonator portion is integrally formed with a second portion of the second exhaust pipe.

In a further aspect, the first and second portions of the second exhaust pipe have generally C-shaped cross-sections that together form a pipe section.

In an additional aspect, at least a portion of the first exhaust pipe is flexible, and at least a portion of the second exhaust pipe is flexible.

In a further aspect, the second exhaust pipe has an inverted U-shaped portion connected to the muffler outlet, a downwardly extending portion connected to the inverted U-shaped portion, and a longitudinal portion connected to the downwardly extending portion and extending rearwardly therefrom.

In an additional aspect, the muffler is disposed above the driveshaft.

In another aspect, an exhaust system for a watercraft is provided. The exhaust system has a muffler adapted to be disposed generally transversely of a longitudinal axis of a hull of the watercraft, the muffler having a muffler inlet and a muffler outlet, a first exhaust pipe connected to the muffler inlet and extending forwardly from the muffler inlet, and a second exhaust pipe connected to the muffler outlet and having a pipe outlet disposed rearwardly of the muffler outlet. The second exhaust pipe extends upwardly and rearwardly from the muffler outlet, then downwardly and rearwardly.

For purposes of this application, terms related to spatial orientation such as forwardly, rearwardly, left and right are as they would normally be understood by a driver of the watercraft sitting thereon in a normal driving position.

Embodiments of the present invention each have at least one of the above-mentioned object and/or aspects, but do not necessarily have all of them. It should be understood that some aspects of the present invention that have resulted from attempting to attain the above-mentioned object may not satisfy this object and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION

Figure 1:
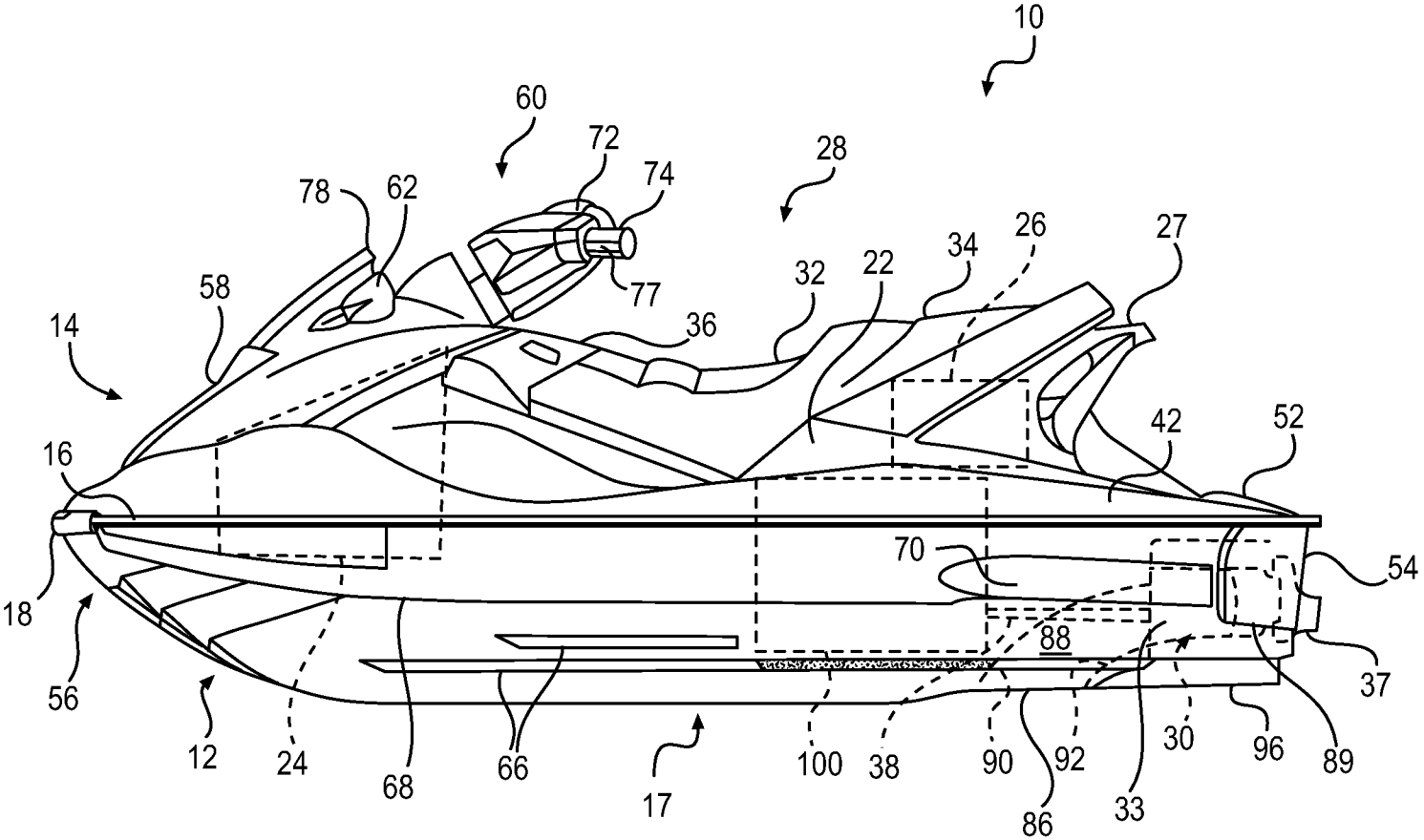
FIG. 1 is a left side elevation view of a personal watercraft.

Referring to FIG. 1, the general construction of a personal watercraft 10 will be described. It should be understood that the personal watercraft 10 could have a construction other than the one described.

The watercraft 10 includes a hull 12 and a deck 14. The hull 12 buoyantly supports the watercraft 10 in the water. The deck 14 is designed to accommodate a driver and a passenger. It is contemplated that the deck 12 could accommodate only the driver or the driver and more than one passenger. The hull 12 and deck 14 are joined together at a seam 16 that joins the parts in a sealing relationship. Preferably, the seam 16 comprises a bond line formed by an adhesive. Other known joining methods could be used to sealingly engage the parts together, including but not limited to thermal fusion, molding or fasteners such as rivets, bolts or screws. A bumper 18 generally covers the seam 16, which helps to prevent damage to the outer surface of the watercraft 10 when the watercraft 10 is docked, for example. The bumper 18 extends around the bow 56. It is contemplated that the bumper 18 could extend around any portion of the seam 16 or the entire seam 16.

The space between the hull 12 and the deck 14 forms a volume, sometimes referred to as the engine compartment. The engine compartment accommodates a power pack that includes an engine 100, as an exhaust system 102 (FIG. 2), a driveshaft 38, electrical system (battery, electronic control unit, etc.), and an air box (not shown). The power pack may include other elements required or desirable in the watercraft 10. The engine 100 will be described in greater details below.

The deck 14 has a centrally positioned straddle seat 28 positioned on top of a pedestal 22 to accommodate the driver and the passenger in a straddling position. The seat 28 includes a first, front seat portion 32 to accommodate the driver and a rear, raised seat portion 34 to accommodate the passenger. The seat portions 32, 34 are removably attached to the pedestal 22 by a hook and tongue assembly (not shown) at the front of each seat portion 32, 34 and by a latch assembly (not shown) at the rear of each seat portion 32, 34, or by any other known attachment mechanism. The seat portions 32, 34 can be individually tilted or removed completely. The seat portions 32, 34 cover an engine access opening defined by a top portion of the pedestal 22 to provide access to the engine 100. The seat portion 34 also covers a removable storage bin 26. A storage box 36 is provided in front of the seat 28. A grab handle 27 is provided between the pedestal 22 and the rear of the seat 28 to provide a handle onto which the passenger may hold.

The watercraft 10 has a pair of generally upwardly extending walls located on either side of the watercraft 10 known as gunwales or gunnels 42. The gunnels 42 help to prevent the entry of water in the footrests (not shown) of the watercraft 10, provide lateral support for the rider's feet, and also provide buoyancy when turning the watercraft 10, since personal watercraft can roll slightly when turning.

A reboarding platform 52 is provided at the rear of the watercraft 10 on the deck 14 to allow the rider or the passenger to easily reboard the watercraft 10 from the water. Carpeting or some other suitable covering covers the reboarding platform 52. A retractable ladder (not shown) may be affixed to a transom 54 of the watercraft 10 to facilitate boarding the watercraft 10 from the water onto the reboarding platform 52.

The watercraft 10 is provided with a hood 58 located forwardly of the seat 28 and a steering assembly including a helm assembly 60. A hinge (not shown) is attached between a forward portion of the hood 58 and the deck 14 to allow hood 58 to move to an open position to provide access to a storage bin 24. A latch (not shown) located at a rearward portion of hood 58 locks hood 58 into a closed position. When in the closed position, the hood 58 prevents water from entering the storage bin 24. Rearview mirrors 62 are positioned on either side of the hood 58 to allow the rider to see behind the watercraft 10. A hook (not shown) is located at the bow 56 of the watercraft 10. The hook is used to attach the watercraft 10 to a dock when the watercraft 10 is not in use or to attach to a winch when loading the watercraft 10 on a trailer, for instance.

The hull 12 has a keel 17 and a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 each have an arcuate undersurface that gives the watercraft 10 both lift while in motion and improved turning characteristics. The sponsons 70 are attached to the hull 12 by fasteners or molded therewith.

A helm assembly 60 is positioned forwardly of the seat 28. The helm assembly 60 has a central helm portion 72, which may be padded, and a pair of steering handles 74. The right steering handle 74 is provided with a throttle operator (not shown), which allows the rider to control the engine 100, and therefore the speed of the watercraft 10. The throttle operator can be in the form of a thumb-actuated throttle lever, a finger-actuated throttle lever, or a twist grip. The left steering handle 74 is provided with a lever 77 used by the driver to control a reverse gate (not shown) of a jet propulsion system 30.

Figure 2:
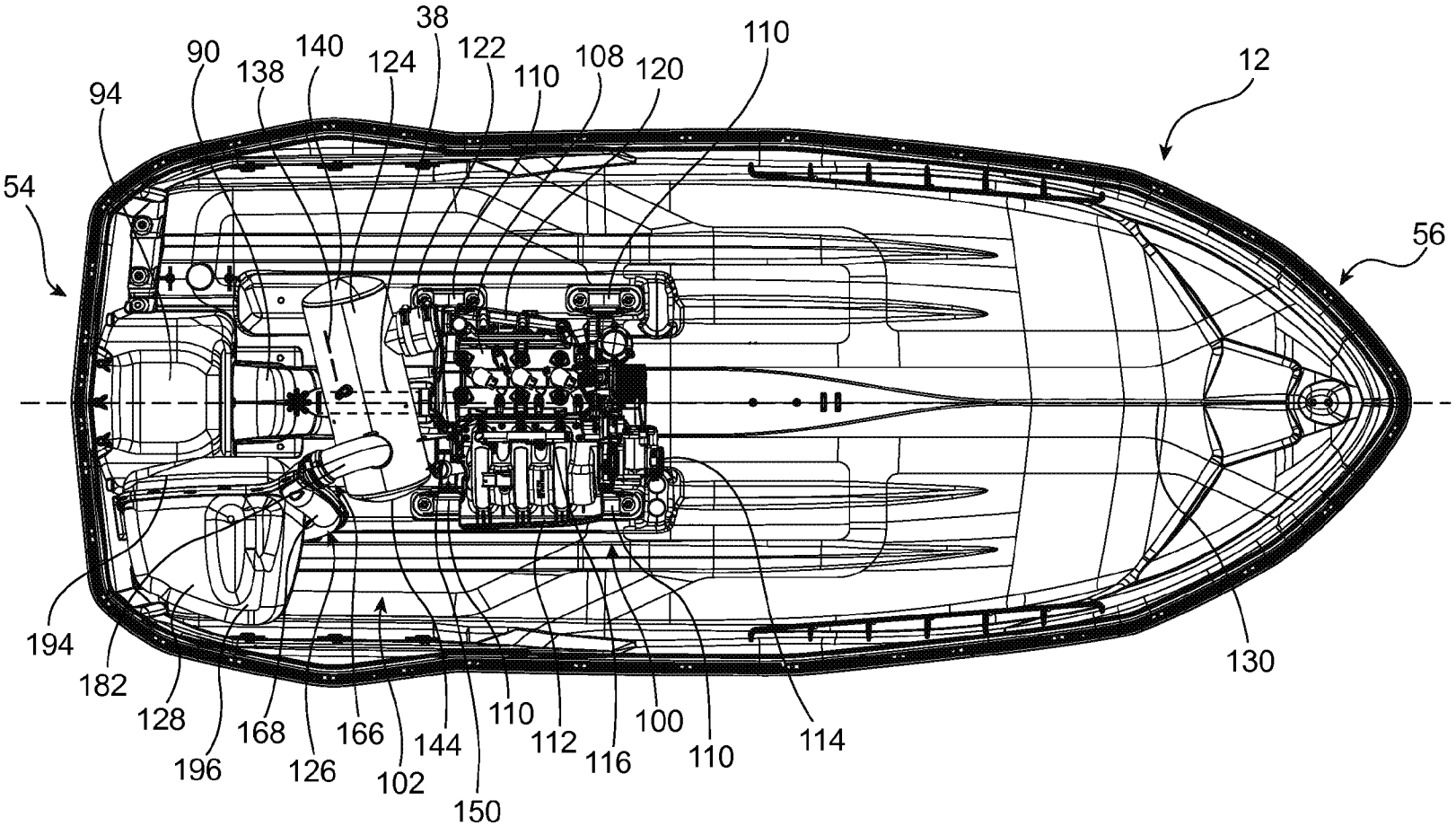
FIG. 2 is a top elevation view of a hull, engine and exhaust system of the personal watercraft of FIG. 1.

The jet propulsion system 30 is partially located in a formation in the hull 12, referred to as the tunnel 94 (FIG. 2). The tunnel 94 is defined at the front, sides, and top by walls formed by the hull 12 and is open at the transom 54. The bottom of the tunnel 94 is closed by a ride plate 96. The ride plate 96 creates a surface on which the watercraft 10 rides or planes at high speeds.

The jet propulsion system 30 pressurizes water to create thrust. The water is first scooped from under the hull 12 through an inlet 86, which has an inlet grate. The inlet grate prevents large rocks, weeds, and other debris from entering the jet propulsion system 30, which may damage the system or negatively affect performance. Water flows from the inlet 86 through a water intake ramp 88. The top portion 90 of the water intake ramp 88 is formed by the hull 12, and a ride shoe (not shown) forms its bottom portion 92. Alternatively, the water intake ramp 88 may be a single piece or an insert to which the jet propulsion system 30 attaches. In such cases, the water intake ramp 88 and the jet propulsion system 30 are attached as a unit in a recess in a bottom of hull 12.

The jet propulsion system 30 includes a jet pump 33. The forward end of the jet pump 33 is connected to a front wall of the tunnel 94. The jet pump 33 includes an impeller and a stator (not shown). The impeller includes blades that extend from a center portion. The impeller is coupled to the engine 100 by the driveshaft 38. An end of the driveshaft 38 is operatively connected to the engine 100. From the engine 100, the driveshaft 38 extends rearwardly and the other end of the driveshaft 38 is operatively connected to the impeller. The engine 100 powers the impeller, which pressurizes the water. The water then moves over the stator that is made of a plurality of fixed stator blades. Once the water leaves the jet pump 33, it goes through a venturi 89 that is connected to the rearward end of the jet pump 33. Since the venturi's 89 exit diameter is smaller than its entrance diameter, the water is accelerated further, thereby providing more thrust.

A steering nozzle 37 is rotationally mounted relative to the venturi 89, so as to pivot about a steering axis. The steering nozzle 37 is operatively connected to the helm assembly 60 preferably via a push-pull cable (not shown) such that when the helm assembly 60 is turned, the steering nozzle 37 pivots about the steering axis. This movement redirects the pressurized water coming from the venturi 89, so as to redirect the thrust and steer the watercraft 10 in the desired direction. It is contemplated that the steering nozzle 37 could be omitted, in which case alternative means may be provided for steering the watercraft 10. For example, the watercraft 10 may alternatively be steered by one or more rudders.

The jet propulsion system 30 is provided with the above-mentioned reverse gate (not shown) which is movable in response to actuation of the lever 77 between a stowed position where it does not interfere with a jet of water being expelled by the steering nozzle 37 and one or more positions where it redirects the jet of water being expelled by the steering nozzle 37. It is contemplated that the reverse gate could be omitted.

A display area or cluster 78 is located forwardly of the helm assembly 60. The display cluster 78 can be of any conventional display type, including a liquid crystal display (LCD), dials or LED (light emitting diodes). The central helm portion 72 has various buttons (not shown), which could alternatively be in the form of levers or switches, that allow the rider to modify the display data or mode (speed, engine rpm, time . . . ) on the display cluster 78. Buttons (not shown) may also be used by the driver to control the jet propulsion system 30. The watercraft 10 includes other features well known in the art that will not be described here.

Turning now to FIGS. 2 to 5, the engine 100 will be described in greater detail. The engine 100 is only one possible engine that could be used. It is contemplated that other types of engines could be used.

Figure 5:
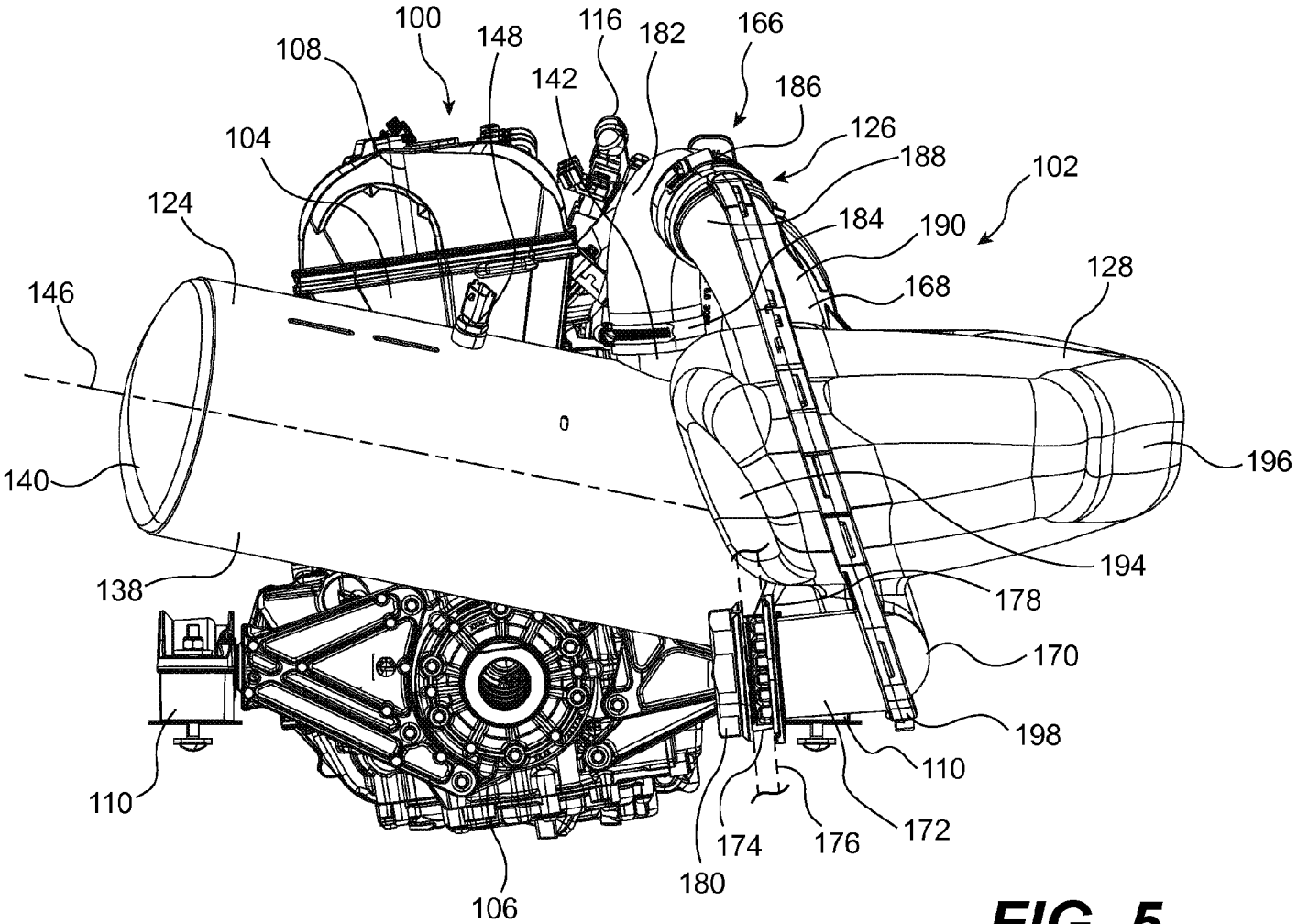
FIG. 5 is rear elevation view of the engine and exhaust system of FIG. 4.

The engine 100 is a four-stroke engine. The engine 100 has three cylinders (not shown) disposed in a straight line next to each other. It is contemplated that a greater or fewer numbers of cylinders could be used. All of the cylinders are formed in a cylinder block 104 (FIG. 5), which sits atop a crankcase 106 (FIG. 5). A cylinder head assembly 108 sits atop the cylinder block 104. A piston (not shown) is housed inside each cylinder and reciprocates therein when the engine 100 is operating. The pistons are linked by connecting rods (not shown) to a crankshaft (not shown), which is housed in the crankcase 106. The engine 100 is mounted to the inside of the hull 12 by four engine mounts 110.

An air intake manifold 112 is connected to the right lateral side of the engine 100. The air intake manifold 112 fluidly communicates with the cylinders to supply air to the cylinders. A throttle body 114 is connected to the air intake manifold to control the flow of air to the air intake manifold 112. The throttle body 114 fluidly communicates with an air box (not shown) disposed in the hull 12 in a forward portion thereof. A fuel rail 116 disposed on the air intake manifold 110 receives fuel from a fuel tank (not shown) and delivers it to three fuel injectors (not shown). Each fuel injector is in fluid communication with the intake passages (not shown) of each cylinder.

An oil tank 118 (FIG. 3) is connected to the engine 100 on the right lateral side of the engine 100 below the air intake manifold 112. The oil tank 118 is shaped such that it follows the contour of the cylinder block 104 and the crankcase 106.

The engine 100 includes other features well known in the art and not described herein.

The exhaust system 102 will now be described with reference to FIGS. 2 to 5. The exhaust system 102 includes an exhaust manifold 120, a left exhaust pipe 122, a muffler 124, a right exhaust pipe 126 and a resonator 128. The resonator 128 is a Helmholtz resonator, but other types of resonators are contemplated.

The exhaust manifold 120 is connected to the left lateral side of the engine 100 on a left side of the longitudinal centerline 130 of the hull 12. The exhaust manifold has three inlets (not shown) fluidly communicating with the three exhaust outlets (not shown) of the cylinders of the engine 100. The exhaust manifold 120 diverges from a front thereof to a rear thereof. The exhaust manifold 120 has a generally rearwardly facing manifold outlet. A central axis (not shown) of the manifold outlet extends slightly toward the longitudinal centerline 130 as it extends rearwardly. The exhaust manifold 120 has an integrally formed cooling jacket (not shown). The cooling jacket receives water from the cooling system of the engine 100 to cool the exhaust manifold 120 and the exhaust gases flowing therein.

Figure 4:
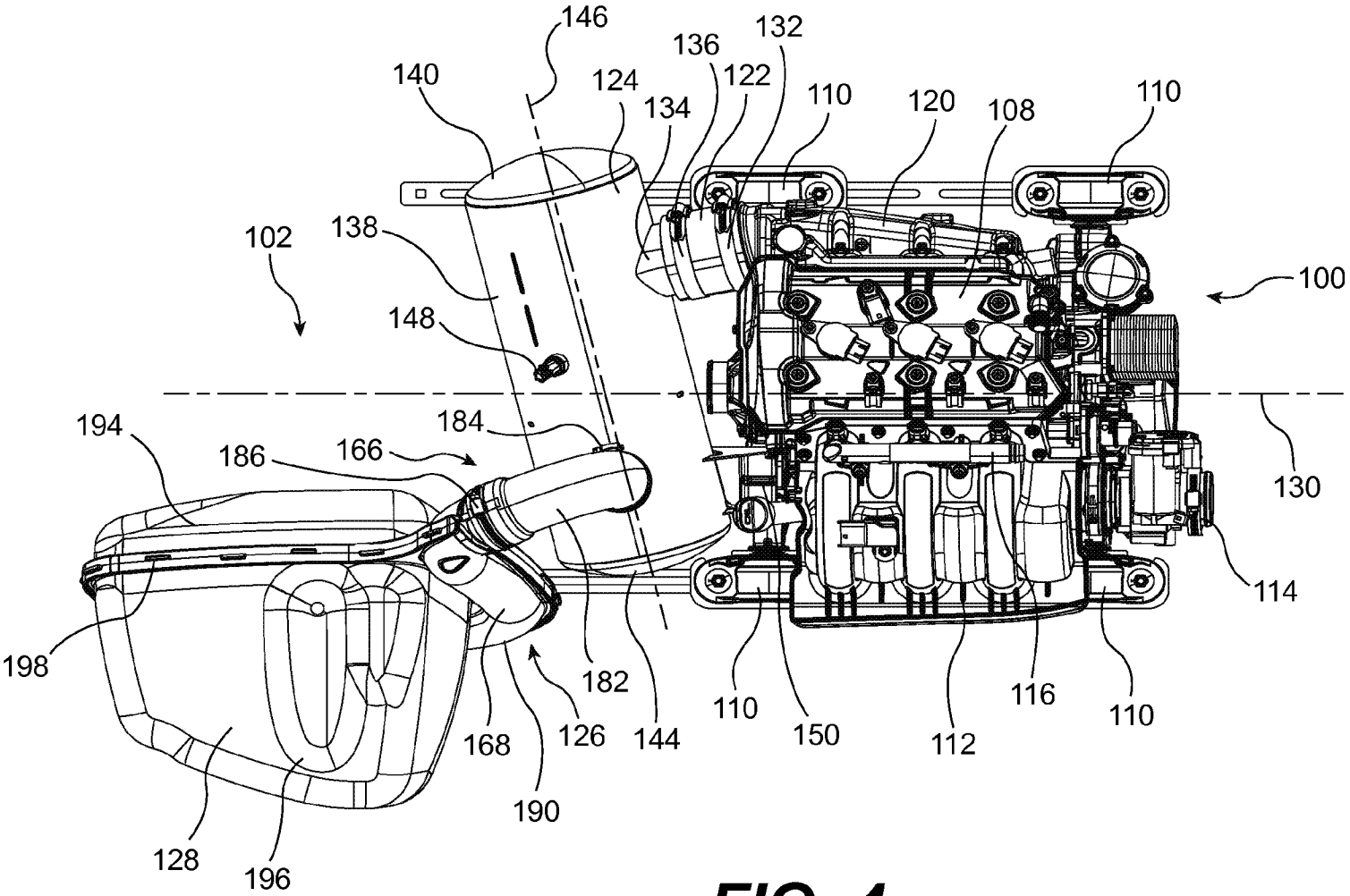
FIG. 4 is a top elevation view of the engine and exhaust system of FIG. 2.

As best seen if FIG. 4, a front end of the left exhaust pipe 122 is disposed over the manifold outlet of the exhaust manifold 120 and is connected to it by a worm gear clamp 132. From its front end, the left exhaust pipe 122 extends generally rearwardly. A central axis (not shown) of the left exhaust pipe 122 extends slightly toward the longitudinal centerline 130 as it extends rearwardly. A rear end of the left exhaust pipe 122 is disposed over an inlet pipe 134 of the muffler 124 and is connected to it by a worm gear clamp 136. As can be seen, the left exhaust pipe 122 is completely disposed on the left side of the longitudinal centerline 130. The left exhaust pipe 122 is made of flexible material, such as rubber or silicon rubber for example, to reduce the transmission of vibrations from the engine 100 to the muffler 124.

Figure 3:
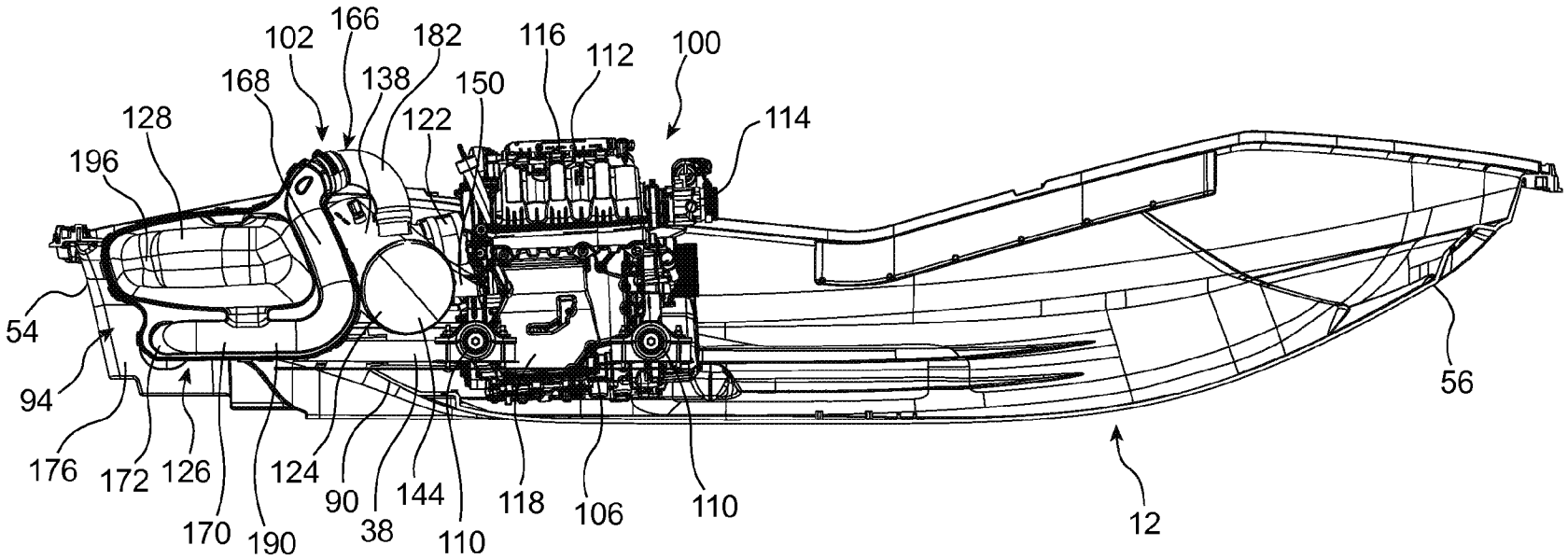
FIG. 3 is a left side elevation view of the hull, engine and exhaust system of FIG. 2 with a portion of the hull cut away.

The muffler 124 has a muffler body 138, the above-mentioned inlet pipe 134, an inlet end 140, an outlet pipe 142, and an outlet end 144. The muffler body 124 is disposed rearwardly of the engine 100 and extends generally transversely. The central axis 146 of the muffler 124, which corresponds to the central axis of the cylindrical muffler body 138, extends downwardly and forwardly as it extends from the inlet end 140 to the outlet end 144. As best seen in FIG. 3, the muffler 124 is disposed above the driveshaft 38. An aperture defined in the muffler body 138 receives a temperature sensor 148 therein that senses a temperature of the exhaust gases in the muffler 124. A bracket 150 connects the muffler body 138 to the engine 100. More specifically, the bracket 150 is connected to the front right side of the muffler body 138 near the outlet end 144 and to the crankcase 106. A damping material (not shown) is provided between the bracket 150 and the crankcase 106 to reduce the transmission of vibrations from the engine 100 to the muffler 124.

The inlet pipe 134 is disposed near the inlet end 140. The inlet pipe 134 extends generally forwardly from a front, left side of the muffler body 138, on a left side of the longitudinal centerline 130. A central axis (not shown) of the inlet pipe 134 extends slightly away from the longitudinal centerline 130 as it extends forwardly. The inlet pipe 134 of the muffler 124 defines a generally forwardly facing muffler inlet. The central axis of the inlet pipe 134 corresponds to a central axis (not shown) of the muffler inlet. A manifold extension pipe (not shown) is connected at its front end to the exhaust manifold 120 around the manifold outlet, extends inside the left exhaust pipe 122 and the inlet pipe 134, and has its rear end inside the muffler body 138. From the exhaust manifold 120, the exhaust gases flow inside the manifold extension pipe and then enter the muffler body 138. A cylindrical gap is formed between the outer side the manifold extension pipe and the inner sides of the left exhaust pipe 122 and of the inlet pipe 134. Water from the cooling jacket of the exhaust manifold 120 flows in the cylindrical gap and is then injected in the muffler body 138.

The outlet pipe 142 is disposed near the outlet end 144. The outlet pipe 142 extends generally vertically from a top, right side of the muffler body 138, on a right side of the longitudinal centerline 130. The outlet pipe 142 of the muffler 124 defines a generally upwardly facing muffler outlet 152 (FIG. 7).

Figure 6:
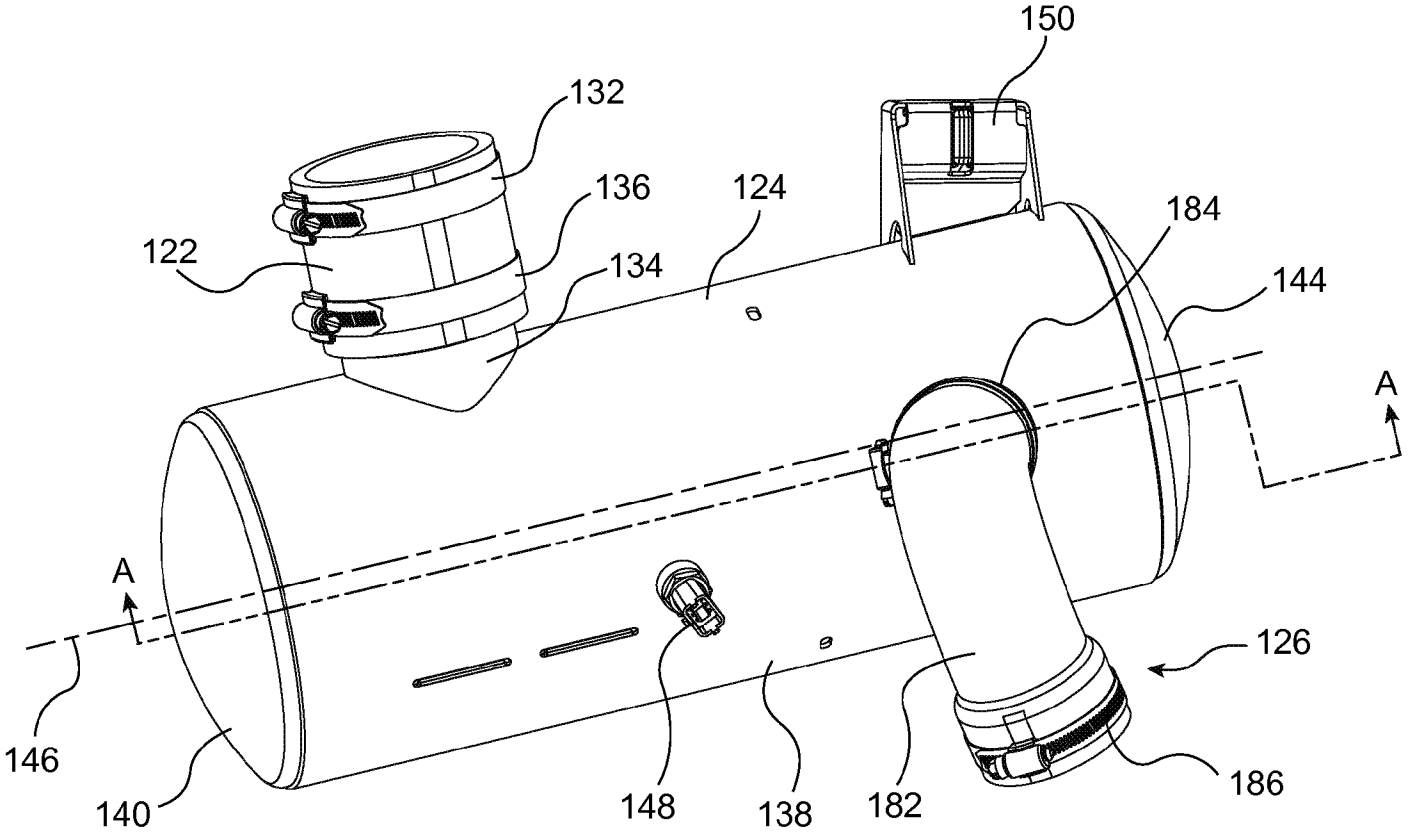
FIG. 6 is a top elevation view of a muffler of the exhaust system of FIG. 2.
Figure 7:
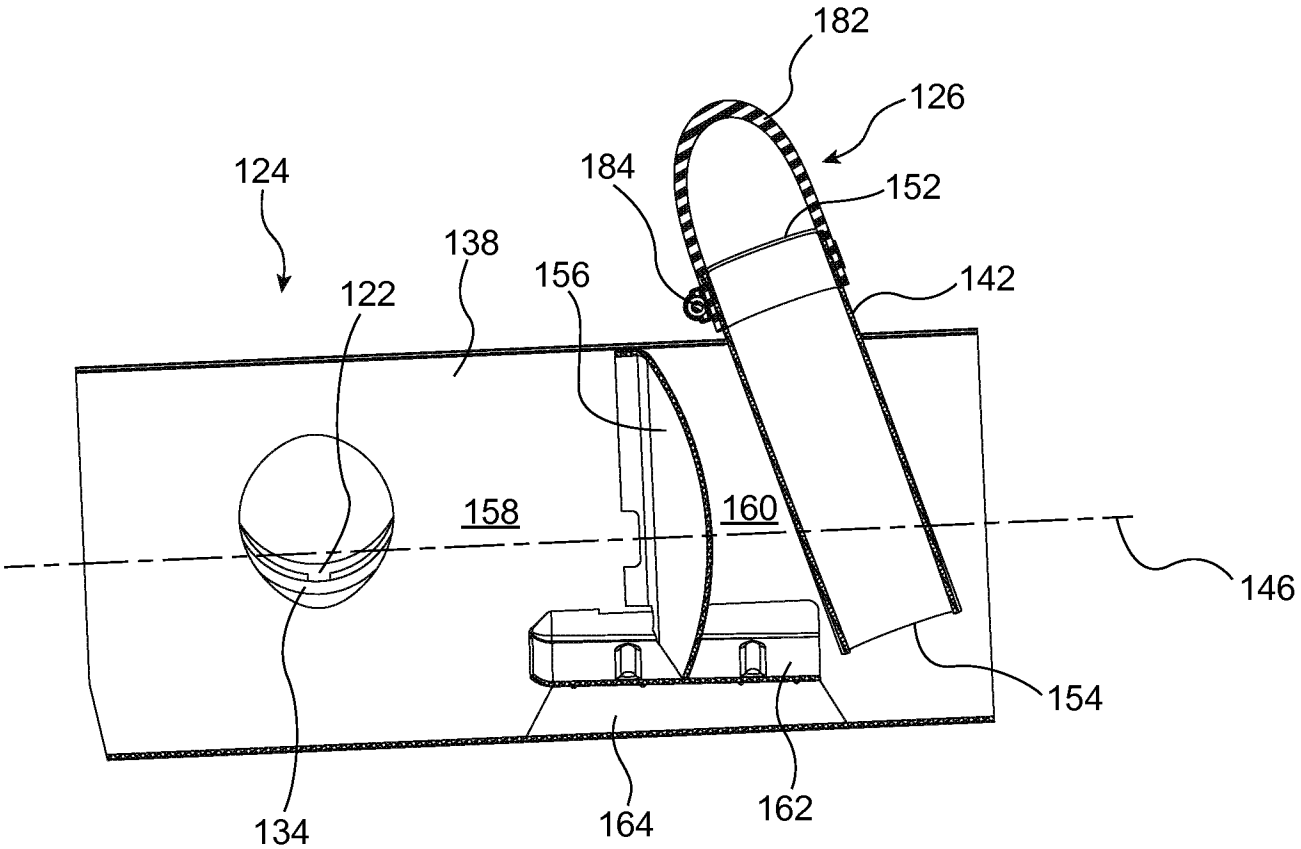
FIG. 7 is a cross-sectional view of the muffler of FIG. 6 taken through line A-A of FIG. 6 with the ends of the muffler removed.

Turning now to FIGS. 6 and 7, the muffler 124 will be described in more detail. The outlet pipe 142 extends outside and inside of the muffler body 138. The inlet 154 of the outlet pipe 142 is disposed below the central axis 146 of the muffler 124. The inlet pipe 134 only extends outside of the muffler body 138. However it is contemplated that the inlet pipe 134 could also extend inside the muffler body 138. The outlet pipe 142 is angled relative to the central axis 146 so as to be generally vertical when the muffler 124 is mounted inside the watercraft 10. A plate 156 is disposed generally transverse to the central axis 146. The plate 156 separates the internal volume of the muffler 124 between a primary chamber 158 and a secondary chamber 160. The primary chamber 158 has a larger volume than the secondary chamber 160. As can be seen in FIG. 7, the inlet pipe 134 opens in the primary chamber 158 and the outlet pipe 142 opens in the secondary chamber 160. A plate 162 is connected to the bottom of the plate 156 and extends on each side thereof. A plate 164 is connected between the bottom of the plate 162 and the bottom of the muffler body 138. The plate 162 and the plate 164 form two passages communicating the primary chamber 158 with the secondary chamber 160. The passages converge from the primary chamber 158 to the secondary chamber 160. The plates 156, 162, 164 are welded to the muffler body 138 and to the plate(s) 156, 162, 164 to which they are connected. A deflector (not shown) is disposed along a rear portion of the muffler body 138 in alignment with the intake pipe 134.

Turning back to FIGS. 2 to 5, the remainder of the exhaust system 102 will be described. The front end of the right exhaust pipe 126 is disposed over the outlet pipe 142 of the muffler 124. From its front end, the right exhaust pipe 126 extends upwardly, rearwardly and then downwardly, thereby forming an inverted U-shaped portion 166. From the inverted U-shaped portion 166, the right exhaust pipe 126 has a downwardly and forwardly extending portion 168. From the downwardly and forwardly extending portion 168, the right exhaust pipe 126 has a longitudinal portion 170 that extends rearwardly. The portions 166 and 168 extend away from the longitudinal centerline 130 as they extend from the muffler 124. The portion 170 is parallel to the longitudinal centerline 130. As best seen in FIG. 5, from the longitudinal portion 170, the right exhaust pipe 126 has a transverse portion 172 extending to the left of the longitudinal portion 170 through an exhaust aperture 174 defined in a wall 176 (shown in dotted lines in FIG. 5) of the tunnel 94. The transverse portion 172 has a flange 178 abutting the inner side of the wall 176. A sealant is provided between the flange 178 and the wall 176 to prevent entry of water inside the hull 12 via the exhaust aperture 174. The portion of the transverse portion 172 that extends inside the tunnel 94 is threaded. A threaded collar 180 (FIG. 5) is fastened over this threaded portion, thereby connecting the right exhaust pipe 126 to the exhaust aperture 174. It is contemplated that the exhaust aperture 174 could be located elsewhere in the hull 12, such as, for example, in the bottom of the hull 12, the transom 54, or a side wall of the hull 12. In such an embodiment, the portion 172 would be oriented so as to connect the longitudinal portion 170 to the exhaust aperture 174. As can be seen, the right exhaust pipe 126 is completely disposed on the right side of the longitudinal centerline 130.

The forward portion of the inverted U-shaped portion 166 of the right exhaust pipe 126 is a pipe 182 made of flexible material, such as rubber or silicon rubber for example. The front portion of the pipe 182 is connected to the outlet pipe 142 of the muffler 124 by a worm gear clamp 184. The rear portion of the pipe 182 is connected to the rearward portion of the inverted U-shaped portion 166 of the right exhaust pipe 126 by another worm gear clamp 186.

The rearward portion of the U-shaped portion 166, the downwardly and forwardly extending portion 168, the longitudinal portion 170 and the transverse portion 172 are made of two longitudinal portions 188, 190. The longitudinal portions 188, 190 have generally C-shaped cross-sections that when connected together form the pipe section made by the U-shaped portion 166, the downwardly and forwardly extending portion 168, the longitudinal portion 170 and the transverse portion 172.

Figure 8:
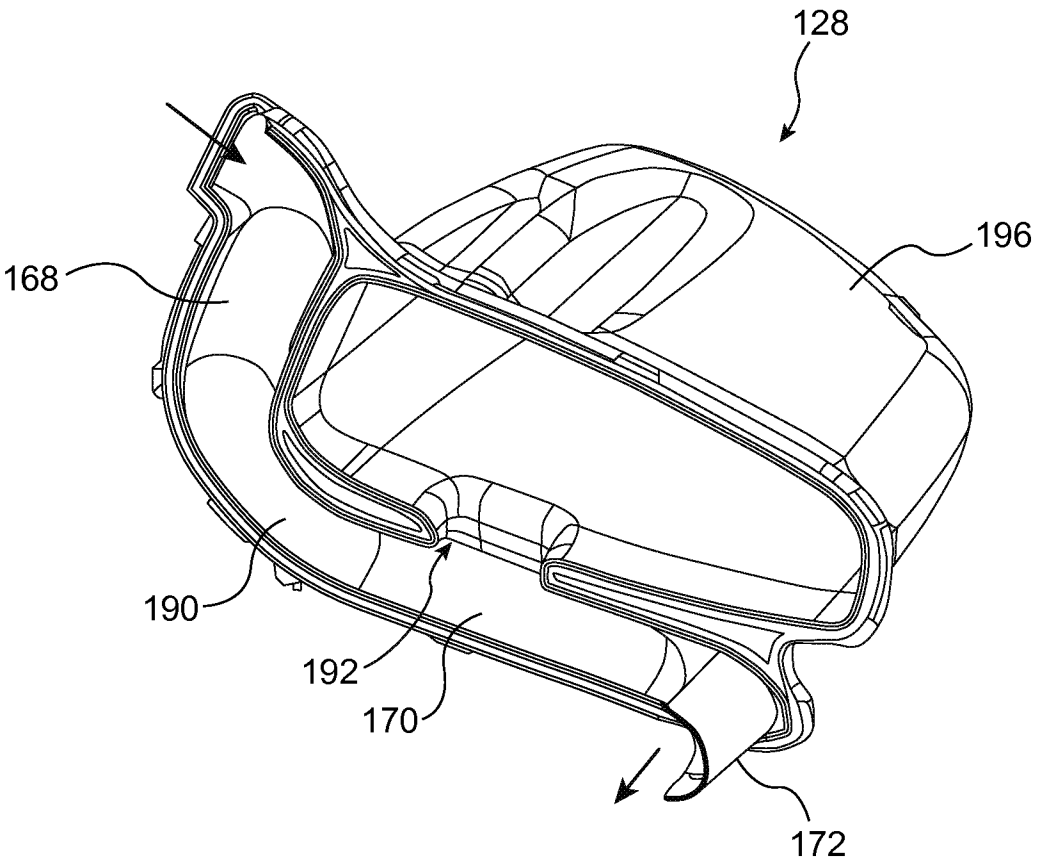
FIG. 8 is a perspective view taken from a rear right side of a right portion of a resonator and a corresponding exhaust pipe portion of the exhaust system of FIG. 2.

The resonator 128 is disposed completely above the longitudinal portion 170 of the right exhaust pipe 126 and is completely disposed on the right side of the longitudinal centerline 130. It is contemplated that portions of the resonator 128 could be disposed below the top of the longitudinal portion 170. The resonator 128 forms a hollow volume that is fluidly connected with the right exhaust pipe 126 via an aperture 192 (FIG. 8) formed in the top of the longitudinal portion 170 of the exhaust pipe 126. The resonator 128 dampens acoustic vibrations passing through the longitudinal portion 170. The resonator 128 is made of two portions 194, 196, with the right portion 196 being larger than the left portion 194. The left portion 194 of the resonator 128 is integrally formed with the left longitudinal portion 188 of the right exhaust pipe 126 via a plastic molding process. Similarly, the right portion 196 of the resonator 128 is integrally formed with the right longitudinal portion 190 of the right exhaust pipe 126 via a plastic molding process as can be seen in FIG. 8. The left portion 194 of the resonator 128 and the left longitudinal portion 188 of the right exhaust pipe 126 are clipped to the right portion 196 of the resonator 128 and the right longitudinal portion 190 of the right exhaust pipe 126 along a seam 198. It is contemplated that these portions 188, 190, 194, 196 could be connected to each other via other means such as threaded fasteners for example.

Modifications and improvements to the above-described embodiments of the present invention may become apparent to those skilled in the art. For example, it is contemplated that the exhaust system 102 could be a mirror image (about the longitudinal axis 130) of the one described above.

The foregoing description is intended to be exemplary rather than limiting. The scope of the present invention is therefore intended to be limited solely by the scope of the appended claims.

What is claimed is:

1. A personal watercraft comprising:

a hull having an exhaust aperture and a longitudinal centerline;

a deck disposed on the hull;

a straddle seat disposed on the deck;

an engine connected to the hull;

a driveshaft operatively connected to the engine and extending rearwardly thereof;

a jet propulsion system operatively connected to the driveshaft; an exhaust manifold connected to a lateral side of the engine on a first side of the longitudinal centerline, the exhaust manifold having a manifold outlet;

a muffler disposed generally transversely and rearwardly of the engine, the muffler having a muffler inlet on the first side of the longitudinal centerline, a muffler outlet on a second side of the longitudinal centerline, an inlet end, an outlet end and a central axis extending downwardly from the inlet end to the outlet end;

a first exhaust pipe connected to the manifold outlet and to the muffler inlet; and a second exhaust pipe connected to the muffler outlet and to the exhaust aperture, the exhaust aperture being disposed rearwardly of the muffler on the second side of the longitudinal centerline, the second exhaust pipe extending upwardly and rearwardly from the muffler outlet, then downwardly and rearwardly to the exhaust aperture.

2. The personal watercraft of claim 1, wherein:

the hull defines a tunnel;

the exhaust aperture is defined in a wall of the tunnel; and at least a portion of the jet propulsion system is disposed in the tunnel.

3. The personal watercraft of claim 1, wherein the first exhaust pipe is disposed on the first side of the longitudinal centerline and the second exhaust pipe is disposed on the second side of the longitudinal centerline.

4. The personal watercraft of claim 1, wherein the central axis extends forwardly from the inlet end to the outlet end.

5. The personal watercraft of claim 1, further comprising a bracket connecting the muffler to the engine.

6. The personal watercraft of claim 5, wherein the bracket is connected to an end portion of the muffler having the muffler outlet.

7. The personal watercraft of claim 1, wherein the manifold outlet faces generally rearwardly and the muffler inlet faces generally forwardly.

8. The personal watercraft of claim 7, wherein the muffler outlet faces generally upwardly.

9. The personal watercraft of claim 1, wherein the second exhaust pipe extends forwardly as the second exhaust pipe extends downwardly and then extends rearwardly.

10. The personal watercraft of claim 1, further comprising a resonator connected to the second exhaust pipe.

11. The personal watercraft of claim 10, wherein the resonator is connected to the second exhaust pipe via an aperture in a top of the second exhaust pipe; and wherein the resonator is disposed above the aperture in the top of the second exhaust pipe.

12. The personal watercraft of claim 11, wherein the aperture in the top of the second exhaust pipe is disposed between a downwardly extending portion of the second exhaust pipe and the exhaust aperture.

13. The personal watercraft of claim 10, wherein the resonator includes a first resonator portion connected to a second resonator portion.

14. The personal watercraft of claim 13, wherein the first resonator portion is integral with a first portion of the second exhaust pipe and the second resonator portion is integral with a second portion of the second exhaust pipe.

15. The personal watercraft of claim 14, wherein the first and second portions of the second exhaust pipe have generally C-shaped cross-sections that together form a pipe section.

16. The personal watercraft of claim 1, wherein at least a portion of the first exhaust pipe is flexible; and wherein at least a portion of the second exhaust pipe is flexible.

17. The personal watercraft of claim 1, wherein the second exhaust pipe has an inverted U-shaped portion connected to the muffler outlet, a downwardly extending portion connected to the inverted U-shaped portion, and a longitudinal portion connected to the downwardly extending portion and extending rearwardly therefrom.

18. The personal watercraft of claim 1, wherein the muffler is disposed above the driveshaft.

* * * * *